US007398951B1

(12) United States Patent
Sugalski et al.

(10) Patent No.: US 7,398,951 B1
(45) Date of Patent: Jul. 15, 2008

(54) URINAL HOLDER

(76) Inventors: Vivian Sugalski, Six Dory St., Jamestown, RI (US) 02835; Mark A. Philips, 69 Tockwotton Farm Rd., North Kingstown, RI (US) 02852

( * ) Notice: Subject to any disclaimer, the term of this patent is extended or adjusted under 35 U.S.C. 154(b) by 129 days.

(21) Appl. No.: 11/029,301

(22) Filed: Jan. 5, 2005

(51) Int. Cl.
*A47K 1/08* (2006.01)

(52) U.S. Cl. ..... 248/311.2; 248/214; 248/299.1; 248/231.71; 5/503.1; 5/658; 403/59

(58) Field of Classification Search ..... 248/214, 248/215, 311.2, 313, 299.1, 286.1, 231.71; 5/507.1, 503.1, 658; D24/128, 122; D7/620; 403/59 X, 80, 68
See application file for complete search history.

(56) References Cited

U.S. PATENT DOCUMENTS

| | | | | | |
|---|---|---|---|---|---|
| D170,538 | S | * | 10/1953 | Love | D24/128 |
| 2,992,804 | A | | 7/1961 | Doran | |
| 3,345,023 | A | | 10/1967 | Scott et al. | |
| 3,473,772 | A | | 10/1969 | Nilson | |
| 3,548,827 | A | | 12/1970 | Abel | |
| 3,653,624 | A | | 4/1972 | Abel | |
| 4,504,992 | A | * | 3/1985 | Herron et al. | 379/454 |
| 4,535,923 | A | * | 8/1985 | Manke | 224/550 |
| D288,054 | S | * | 2/1987 | Schulte et al. | D7/620 |
| 5,282,599 | A | | 2/1994 | Arpaia et al. | |
| 5,788,198 | A | * | 8/1998 | Sharpe | 248/210 |
| 5,839,632 | A | * | 11/1998 | Koday | 224/414 |
| 5,857,601 | A | * | 1/1999 | Greenwood | 224/409 |
| 5,984,249 | A | * | 11/1999 | Cohen | 248/226.11 |
| D468,014 | S | * | 12/2002 | Girod | D24/128 |

FOREIGN PATENT DOCUMENTS

| | | | |
|---|---|---|---|
| CA | 2266797 | A * | 3/1999 |

* cited by examiner

*Primary Examiner*—Gwendolyn Baxter
(74) *Attorney, Agent, or Firm*—Salter & Michaelson

(57) ABSTRACT

A holder for a hand-held urinal that is for releasable mounting from a bed rail or the like. The holder includes a mounting bracket having at least one plate member that is supported from the bed rail; and a holder for receiving the hand-held urinal. The holder is removably supportable from the plate member and includes a headed stud constructed and arranged facing the plate member and for engagement with an arcuate slot in the plate member to permit pivotal support of the holder from the mounting bracket while providing limited sliding motion between the headed stud and slot so as to enable the holder to stay substantially vertical even as the mounting bracket tilts.

4 Claims, 13 Drawing Sheets

URINAL HOLDER

BACKGROUND

1. Technical Field

The present invention relates to a holder or retainer for supporting a hand-held urinal. More particularly, the present invention relates to such a holder that is adapted for use, for example, in a hospital or nursing facility.

2. Related Art

The bed-ridden patient typically requires the use of a hand-held urinal device. With the ever increasing workload imposed on nurses and orderlies, it is usually desirable to have the urinal stationed within easy reach from the bed. These portable urinals are either left standing or hung by their handle from the bedrail. In either case spillage can occur leading to an unsterile situation.

The prior art does describe urinal holders for bedside use such as in, for example, U.S. Pat. Nos. 3,473,772 and 3,653,624. However, these holders are generally not easily attachable and detachable from the bedrail. Furthermore, these prior art holders do not provide a simple and effective means for maintaining their upright position even as the bedrail is tilted.

Accordingly, it is an object of the present invention to provide an improved urinal holder particularly one that is of simple construction and that can be readily attached to and detached from the bedside.

Another object of the present invention is to provide an improved urinal holder that is constructed and arranged to be easily maintained in a vertical upright position even as the bed or bedrail is tilted.

SUMMARY

To accomplish the foregoing and other objects, features and advantages of the present invention there is provided a holder or retainer for a hand-held urinal that is for releasable mounting from a bed rail or the like. The holder comprises a mounting bracket including at least one plate member that is supported from the bed rail and a holder for receiving the hand-held urinal. The holder is removably supportable from the plate member and includes a headed stud constructed and arranged facing the plate member and for engagement with an arcuate slot in the plate member to permit pivotal support of the holder from the mounting bracket while providing limited sliding motion between the headed stud and slot so as to enable the holder to stay substantially vertical even as the mounting bracket tilts. This support arrangement also enables ready engagement and disengagement of the holder with the support member or mounting bracket.

In accordance with other aspects of the present invention, the mounting bracket includes first and second plate members and a securing knob attached therebetween to provide an adjustment of the position of the plate members relative to the bed rail; the first plate member includes said arcuate slot and has a top flange that engages the bed rail; the second plate member has a top flange for engaging under the bed rail; the knob engages between the plate members and is adjustable in an elongated slot of the first plate member; a lip is provided between the plate members for restricting motion therebetween; the first plate member has a hole therethrough that connects to said arcuate slot and is for initially receiving the headed stud that subsequently rests in the arcuate slot; the through hole is disposed over the slot and has a diameter greater than the diameter of the headed stud so as to be able to receive the headed stud and engage a neck of the headed stud in the arcuate slot; the arcuate slot connects with the through hole generally at a midpoint of the slot, and the width of the slot is preferably less than the diameter of the headed stud so as to retain the headed stud in the arcuate slot; the holder comprises a multi-walled structure with a bottom on which the urinal rests; the headed stud is disposed extending from a rear wall of the holder adjacent a top end thereof and includes a neck having a smaller diameter than the diameter of the head and received in said arcuate slot; and the multi-walled structure includes a front wall with an elongated vertical gap through which the content of the urinal can be observed.

In accordance with a further aspect of the present invention there is provided a holder for a hand-held urinal that is for releasable mounting from a bed rail or the like. The holder comprises, a mounting bracket including a pair of adjustable plate members that are adapted for attachment to the bed rail and a multi-walled holder for receiving the hand-held urinal and including a bottom wall upon which the urinal rests. The holder is removably supportable from a first of said plate members and includes a headed stud constructed and arranged facing the first plate member and for engagement with a passage in the first plate member, said passage permitting pivotal support of the holder from the mounting bracket at a neck defining the headed stud so as to enable the holder to stay substantially vertical even as the mounting bracket tilts.

In accordance with still another aspect of the present invention, the passage includes an arcuate slot communicating with a round hole, the headed stud adapted to be initially received through the round hole, resting in the arcuate slot when fully seated; the round hole is disposed over the slot and has a diameter greater than the diameter of the headed stud so as to be able to receive the headed stud and engage the neck of the headed stud in the arcuate slot; the arcuate slot connects with the round hole at a midpoint of the slot and the width of the slot is less than the diameter of the headed stud so as to retain the headed stud in the arcuate slot; the headed stud is disposed extending from a rear wall of the holder adjacent a top end thereof and the neck has a smaller diameter than the diameter of the head and is received in said arcuate slot; and the multi-walled holder includes a front wall with an elongated vertical gap through which the content of the urinal can be observed.

In accordance with still a further aspect of the present invention there is provided a holder for a hand-held urinal that is for releasable mounting from a bed rail or the like. The holder comprises a mounting bracket including a pair of plate members that are supportable from the bed rail and that further include a lip means that restricts the adjustment between the plate members to a direction of a longitudinal axis of the plate members. A knob is provided for holding the plate members together and enabling adjustment therebetween so as to fit and be secured to the bed rail. The knob has loose and tight positions, in the loose position being adjustable to enable the plate members to move relative to each other in the direction of the longitudinal axis, and in the tight position securing the plate members in a fixed orientation. A multi-walled holder is for receiving the hand-held urinal and including a bottom wall upon which the urinal rests; one of said plate members having means defining a hole of predetermined diameter that is contiguous with and disposed over an arcuate slot of predetermined width. The holder is removably supportable from the one plate member; a headed stud on the holder is constructed and arranged facing the one plate member; the headed stud is defined by a neck and is disposed extending from a rear wall of the holder adjacent a top end thereof; said neck having a smaller diameter than the diameter of the head; and said headed stud initially received in the hole and subsequently positioned with the neck engaged in the arcuate slot so as to permit pivotal support of the holder from the mounting bracket while providing limited sliding motion between the headed stud and slot so as to enable the holder to stay substantially vertical even as the mounting bracket tilts.

In accordance with another aspect of the present invention there is provided a holder for a hand-held urinal that is for releasable mounting from a bed rail or the like, comprising: a mounting bracket including at least one plate member that is supported from the bed rail in a substantially vertical orientation; and a holder for receiving the hand-held urinal including a bottom wall upon which the urinal rests. The holder is removably supportable from the plate member. A male member is supported from either the plate member or bracket and is for engagement with a female member defining an arcuate slot in either the plate member or bracket so as to permit pivotal support of the holder from the mounting bracket by means of the interengagement of a neck of the male member with the slot. The male and female members may be constructed and arranged to provide limited sliding motion therebetween so as to enable the holder to stay substantially vertical even as the mounting bracket tilts.

The foregoing and other objects, features and advantages of the disclosure will be apparent from the following more particular description of preferred embodiments of the disclosure, as illustrated in the accompanying drawings in which like reference characters refer to the same parts throughout the different views. The drawings are not necessarily to scale, emphasis instead being placed upon illustrating the principles of the disclosure. The principles and features of this disclosure may be employed in varied and numerous embodiments without departing from the scope of the disclosure.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION OF THE PREFERRED EMBODIMENTS

Figure 1:
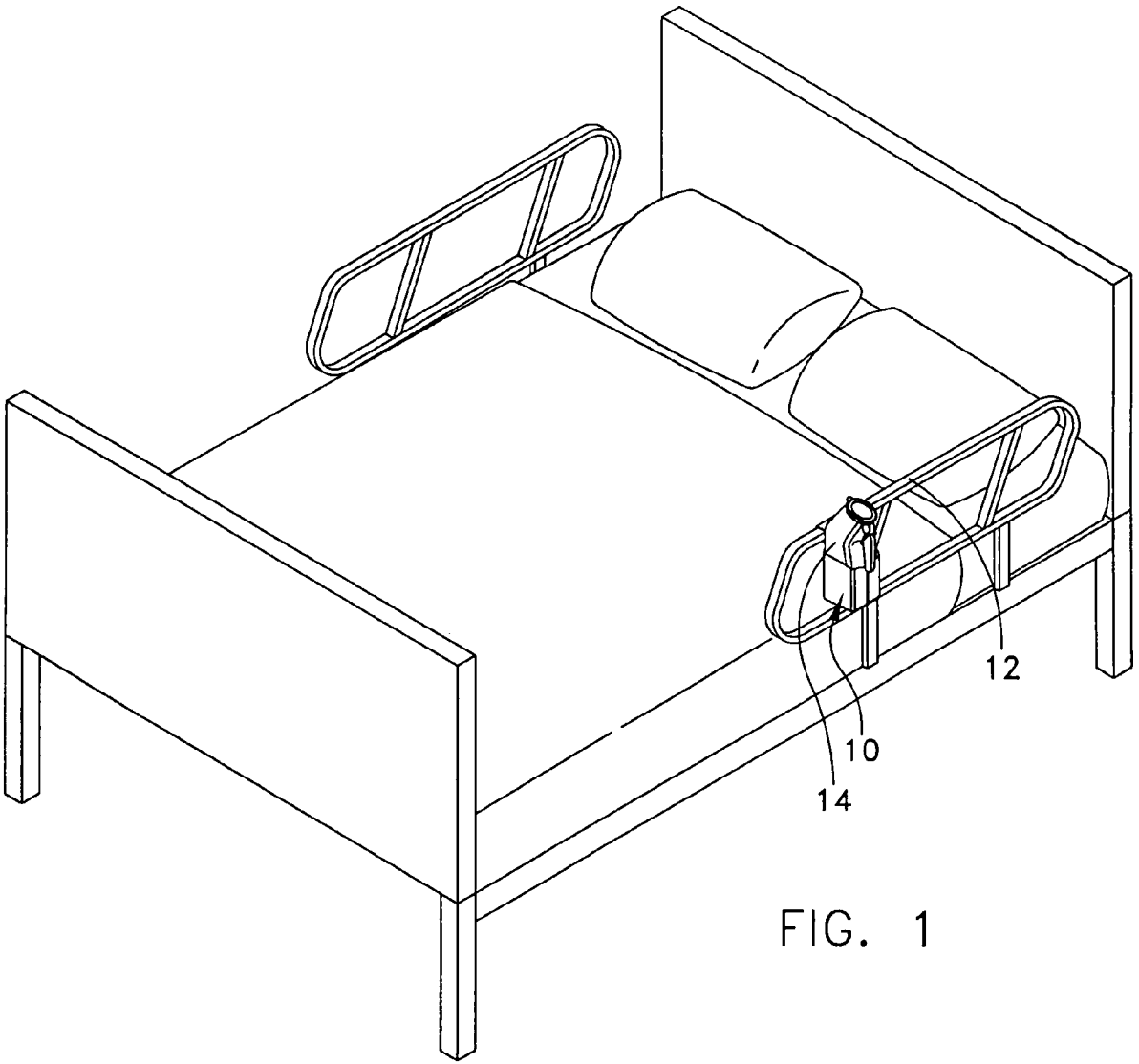
FIG. 1 is a perspective view illustrating the urinal holder of the present invention as attached to a bedrail.
Figure 2:
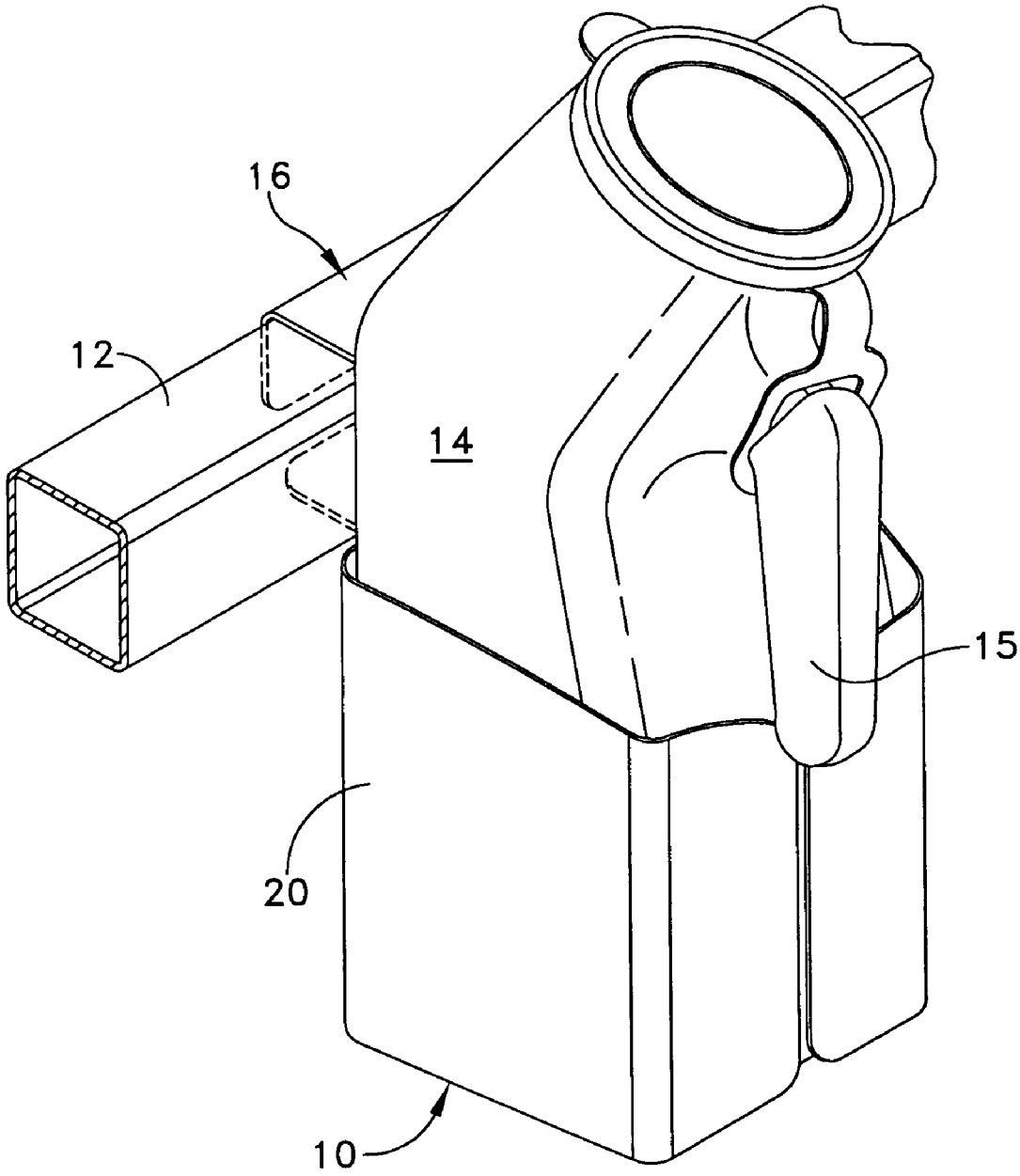
FIG. 2 is a perspective view of the urinal holder as attached to a bedrail and supporting the handheld urinal therein.
Figure 3:
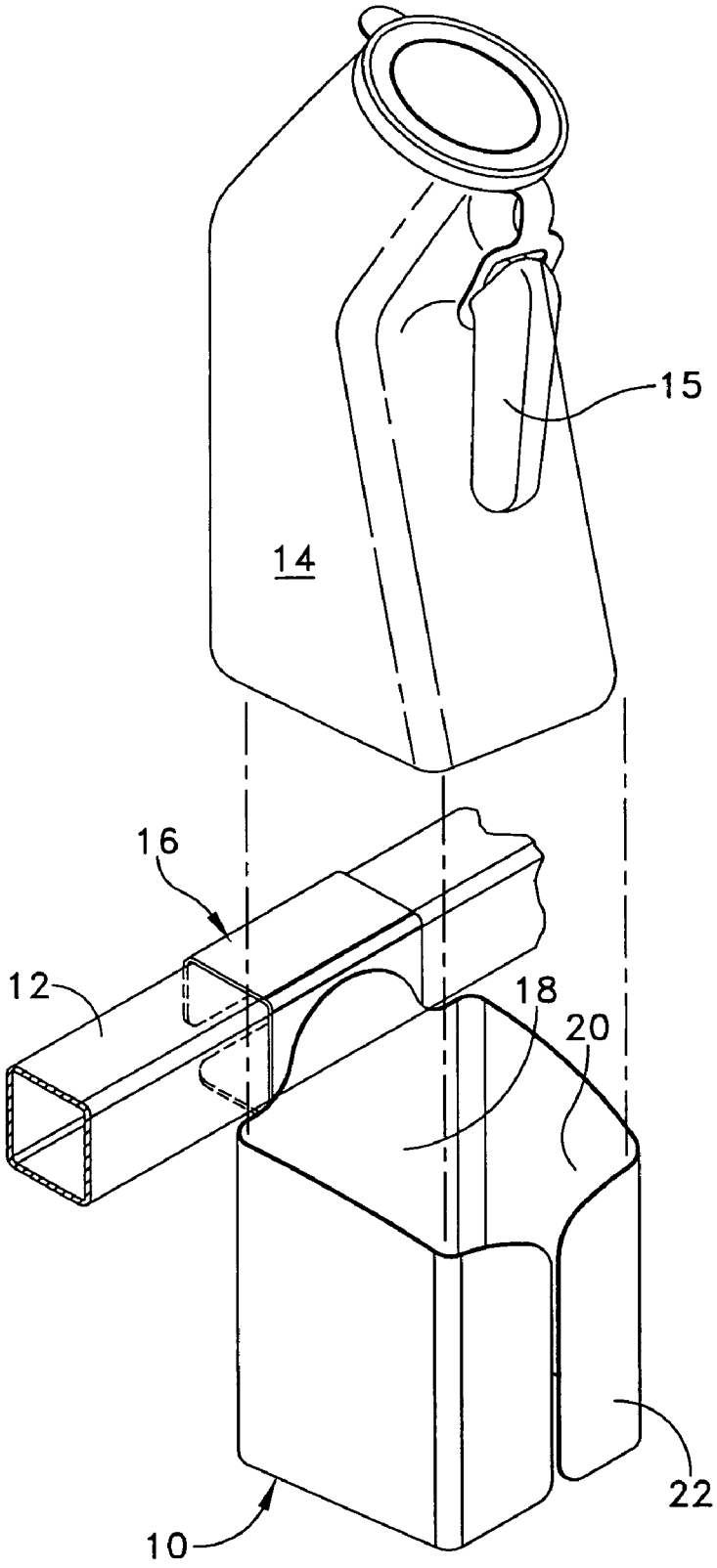
FIG. 3 is a perspective view similar to the view of FIG. 2 illustrating the handheld urinal exploded away from the holder.

Reference is now made to the drawings for an illustration of a preferred embodiment of the urinal holder of the present invention. FIG. 1 illustrates the urinal holder 10 attached in a bedside position to the bedrail 12. FIGS. 1-3 illustrate the hand-held urinal 14 which is seated within the holder. FIG. 2 shows the urinal resting in the holder, while FIG. 3 shows the urinal 14 exploded above the holder. FIGS. 2 and 3 also illustrate the holder being secured from the bedrail 12 by means of the mounting bracket 16.

In accordance with the present invention, the holder is removably supportable from the mounting bracket by means of a headed stud that is constructed and arranged facing the bracket and for engagement with an arcuate slot of the bracket to permit pivotal support of the holder from the mounting bracket while providing some limited sliding motion between the headed stud and the slot so as to enable the holder to stay substantially vertical even as the mounting bracket tilts.

Figure 4:
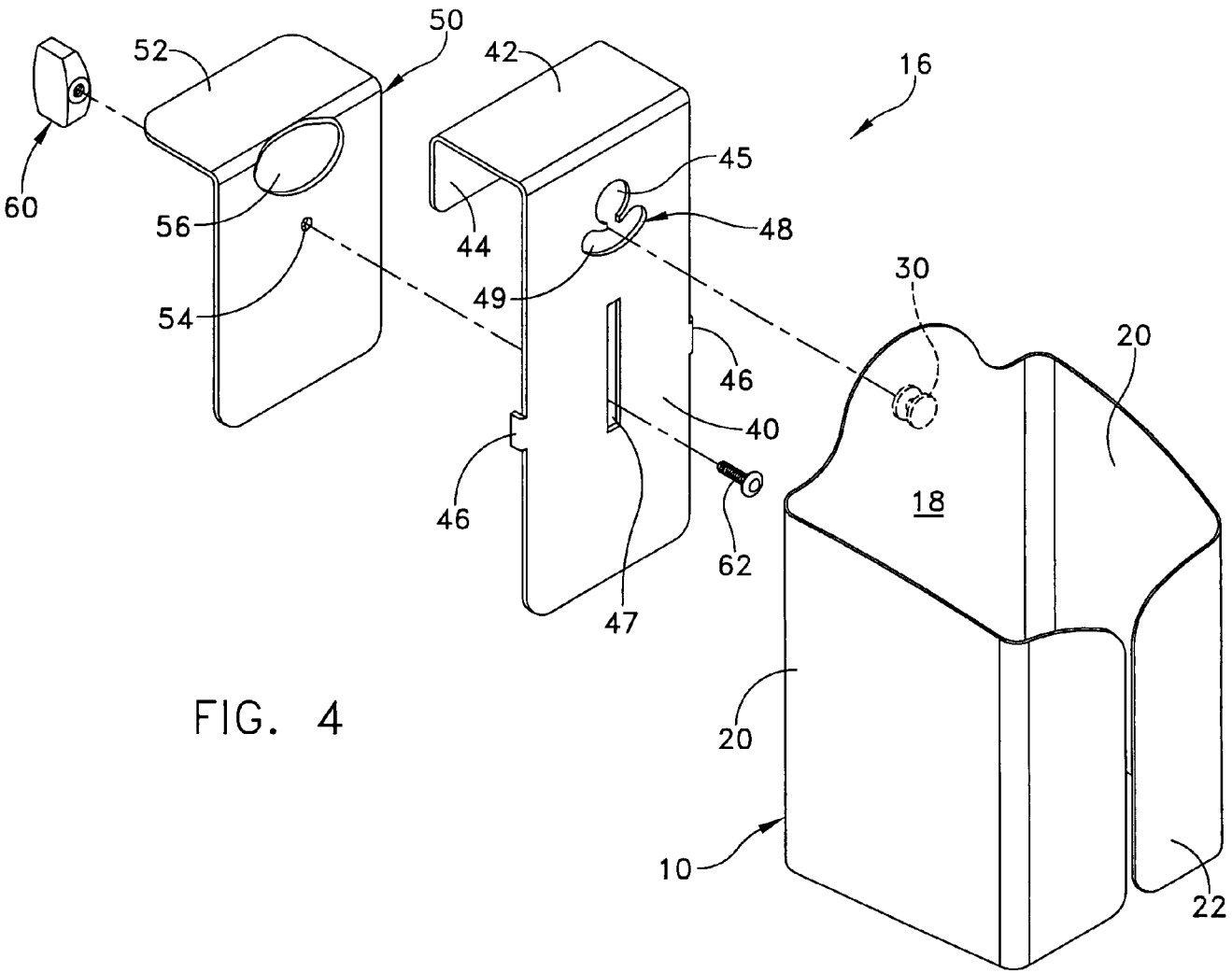
FIG. 4 is an exploded perspective view illustrating the components of the holder of the present invention.

FIG. 4 is an exploded view illustrating the main components of the holder of the present invention. FIGS. 5-8 provide further details of the mounting bracket. The part of the holder that directly receives the hand-held urinal is a multi-walled, open-top structure including a rear wall 18, side walls 20, front wall 22, and bottom wall 24. The bottom of the urinal 14 rests upon wall 24. As illustrated in FIG. 2, the handle 15 of the urinal preferably faces forwardly. The front, rear and side walls effectively support the urinal 14 in a stable position. The rear wall 18 carries the headed stud 30.

Figure 11:
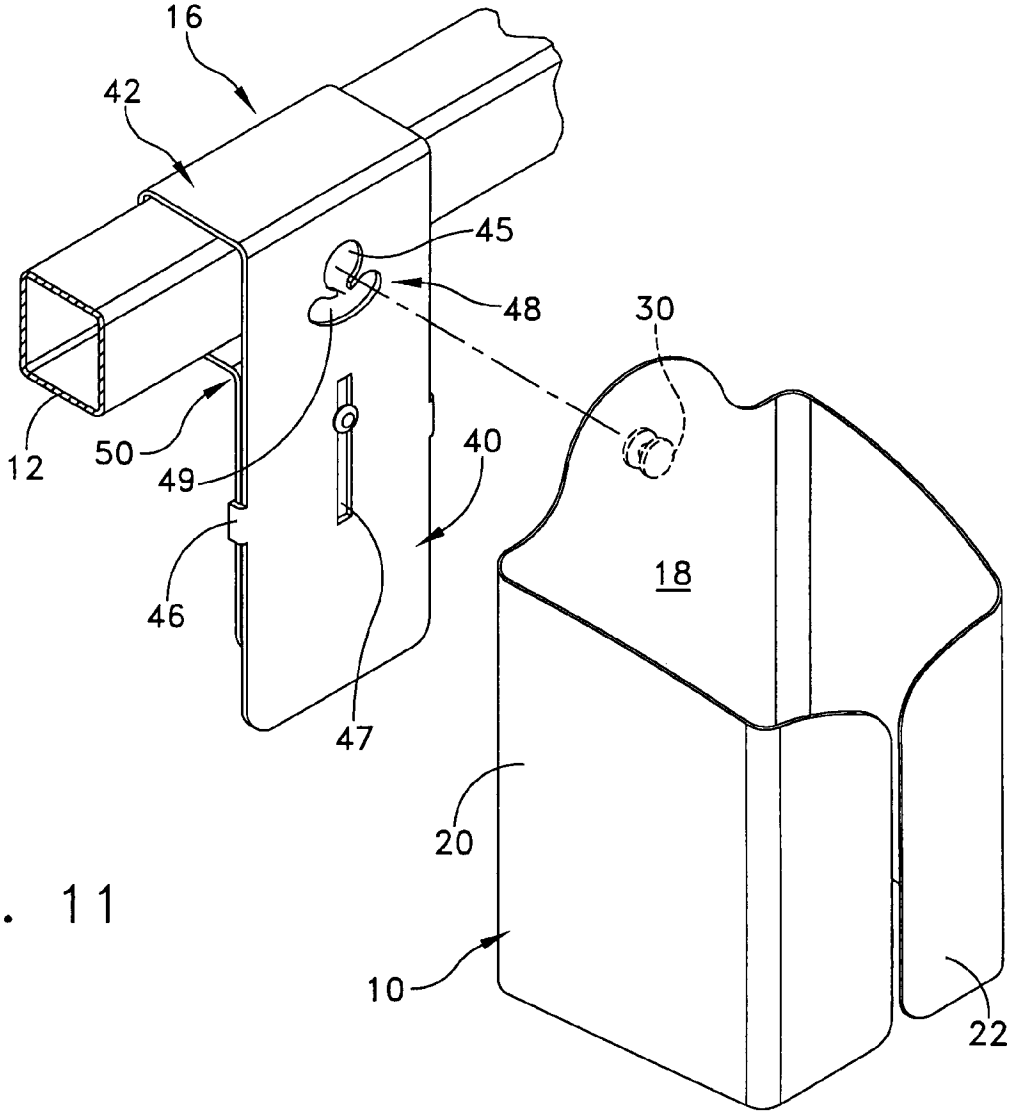
FIG. 11 is an exploded perspective view illustrating the holder and mounting bracket.

As illustrated in FIGS. 4-8, the mounting bracket 16 is comprised of first and second plate members and a securing knob. These are identified in the drawings as plate member 40, plate member 50 and knob 60. The plate member 40 has a top flange 42 with a down-turned edge 44. The flange 42 and down-turned edge 44 are adapted to fit over the bedrail 12, such as shown in FIG. 3. The plate member 40 also includes side lips 46 that engage with the other plate member, such as is illustrated in FIG. 11.

The plate member 40 of the mounting bracket 16 also includes an elongated slot 47 that essentially extends longitudinally of the long dimension of the plate member. The slot 47 received the securing bolt 62 which threads into an internally threaded hole in the knob 60. The bolt 62 preferably is a carriage-type bolt having a square portion below the head that fits and can slide within the elongated rectangularly shaped slot 47. The plate member 40, which may also be considered as a female member, also includes an opening or passage 48 that is adapted for engagement by the headed stud 30. The passage 48 may be considered as having two contiguous portions including a round hole 45 and an arcuate slot 49. As will be described in further detail hereinafter, the headed stud 30, which may be considered as a male member, is initially inserted through the hole 45 and then has its neck drop into and engage the slot 49.

The mounting bracket 16 also includes a second plate member 50 that includes a top flange 52, a hole 54 through which the securing bolt 62 passes and an aperture 56 that provides an unobstructed area for receiving the headed stud 30.

Figure 6:
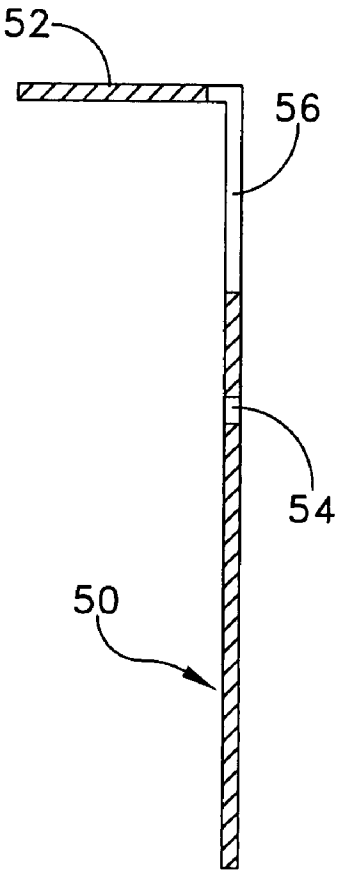
FIG. 6 is a cross-sectional view as taken along lines 6-6 of FIG. 5.
Figure 5:
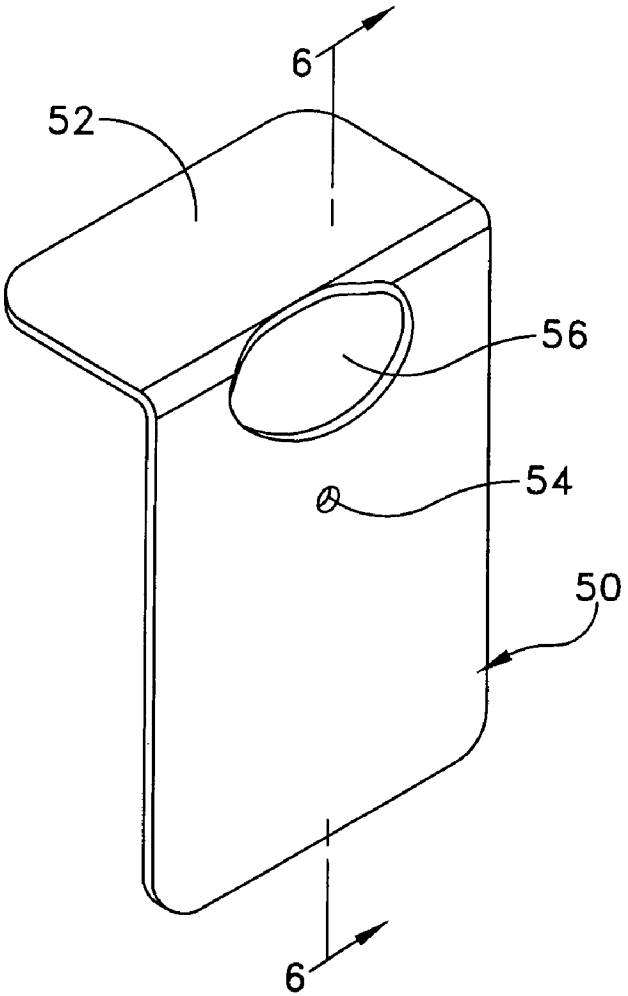
FIG. 5 is a perspective view of one of the plate members of the mounting bracket.
Figure 8:
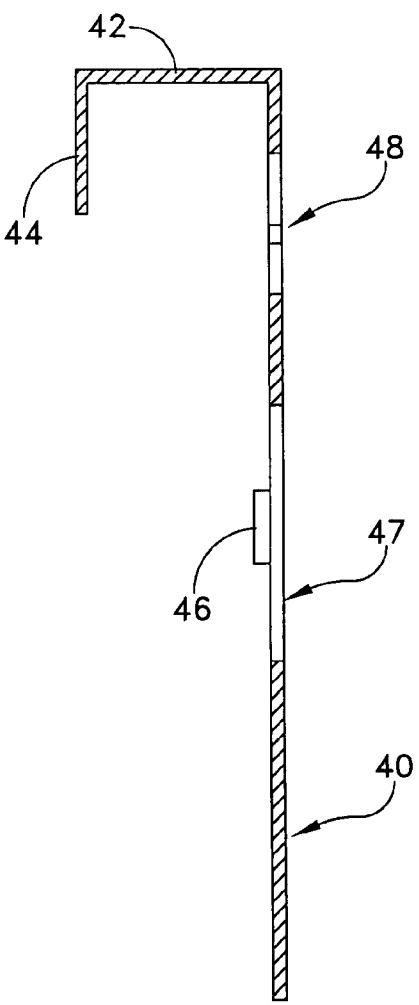
FIG. 8 is a cross-sectional view taken along line 8-8 of FIG. 7.
Figure 7:
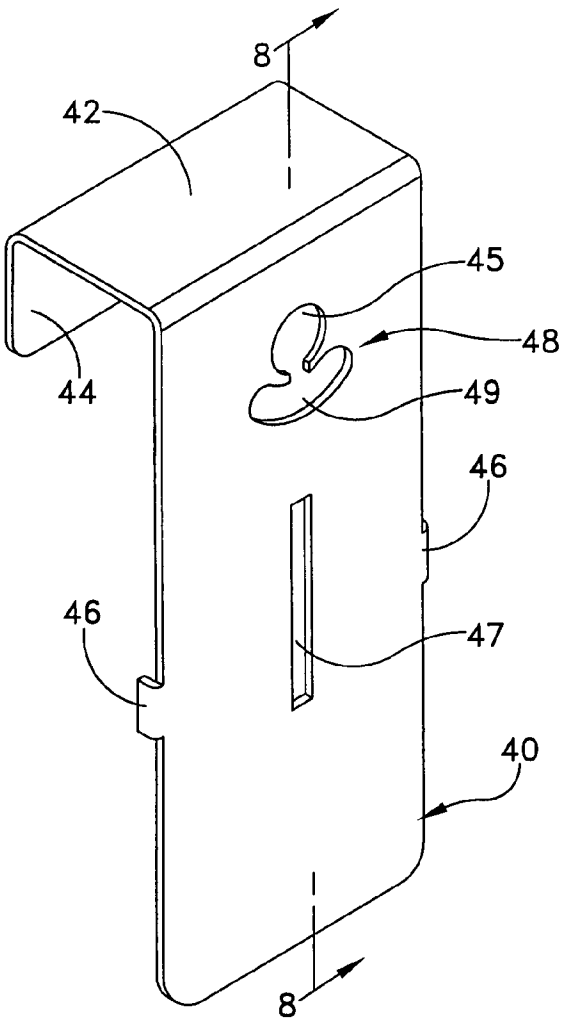
FIG. 7 is a perspective view of the other plate member of the mounting bracket.
Figure 10:
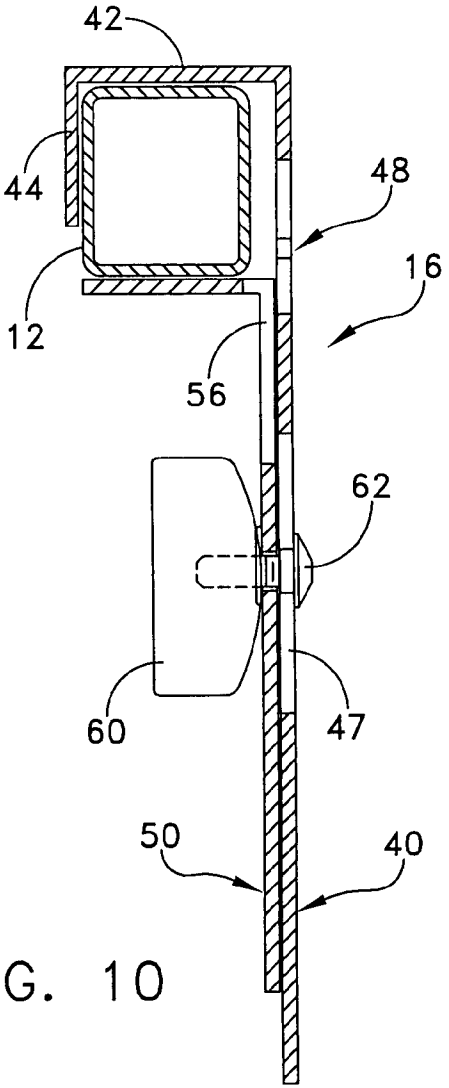
FIG. 10 is a cross-sectional view through the mounting bracket with the knob in its locked position securing the mounting bracket to the bedrail.
Figure 9:
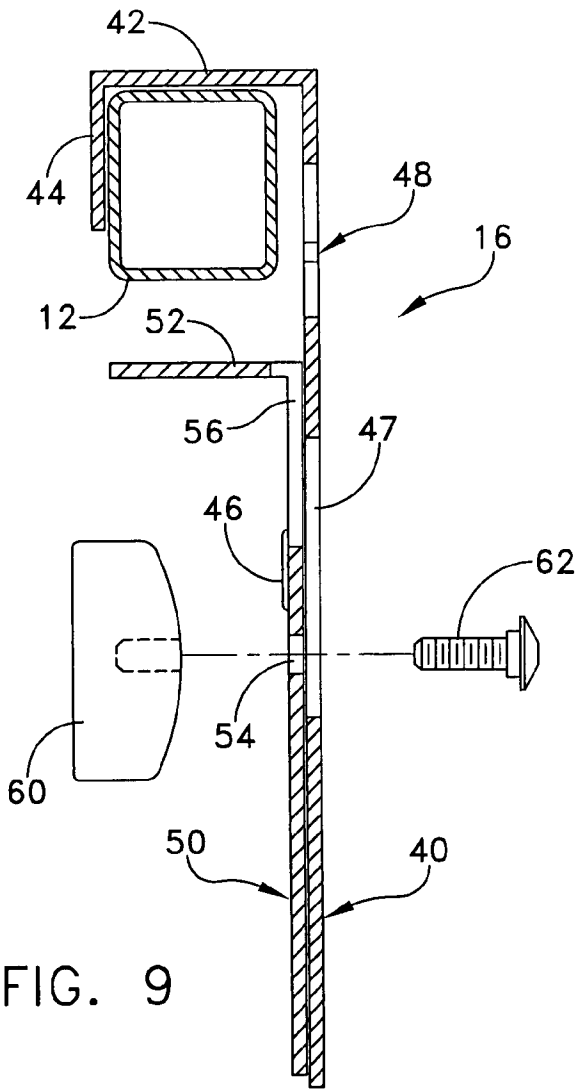
FIG. 9 is a cross-sectional view through the mounting bracket with the knob exploded away.

As indicated previously, FIGS. 1-4 illustrate the main components of the urinal holder of the present invention. FIGS. 5 and 6 provide further details of the plate member 50 while FIGS. 7 and 8 provide further details of the plate member 40. FIGS. 9 and 10 are further cross-sectional views with the two plate members in various positions and also illustrating the knob 60. In FIG. 9 the knob 60 and the securing bolt 62 are shown separate from the plate members. This is the position in which the mounting bracket is about to be engaged with the rail 12. In FIG. 9 the top flange 42 and down-turned edge 44 are shown engaging about the rail 12. The top flange 52 of the other plate member 50 is at a lower position enabling the plate member 40 to be disposed about the rail. The plate member 50 is adapted for vertical sliding relative to the plate member 40 with any side-to-side motion restricted by the lips 46 extending from the plate member 40 in the direction of the plate member 50. The cross-sectional view of FIG. 10 illustrates the plate member 50 now slid upwardly into engagement with the rail 12. FIG. 10 also illustrates the knob 60 secured in place. The knob 60 may be rotated on the securing bolt 62 until it is urged against the wall of the plate member 50. This secures the relative position between the two plate members. In FIG. 10 the mounting bracket 16 is thus fixed in position on the bedrail 12. The perspective view of FIG. 11 also shows the mounting bracket secured in place on the rail 12. Also depicted in FIG. 11 is the holder having the headed stud 30 in line with the passage 48 in the mounting bracket.

Figure 12:
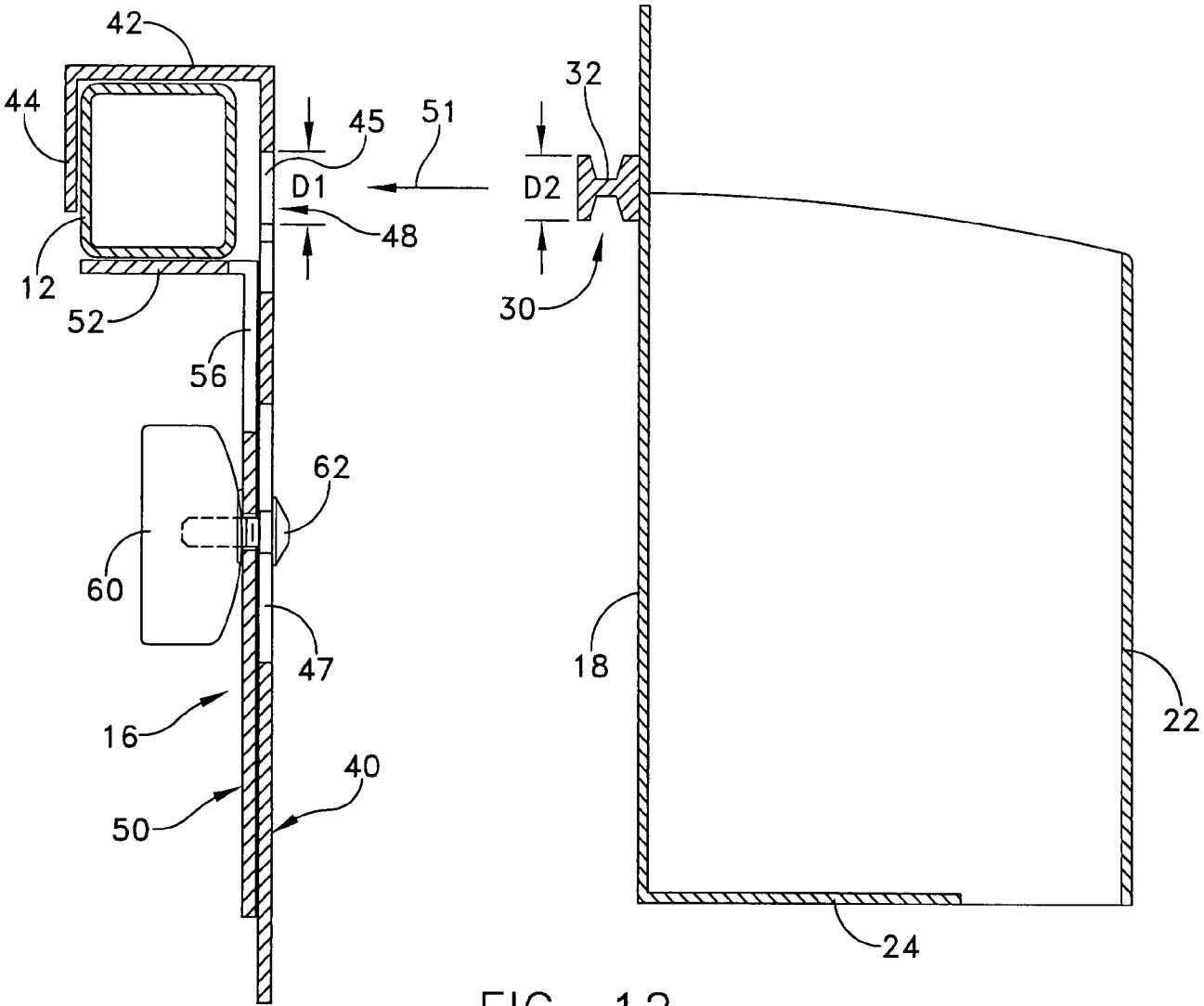
FIG. 12 is a cross-sectional view showing the holder and mounting bracket and the engagement therebetween.
Figure 13:
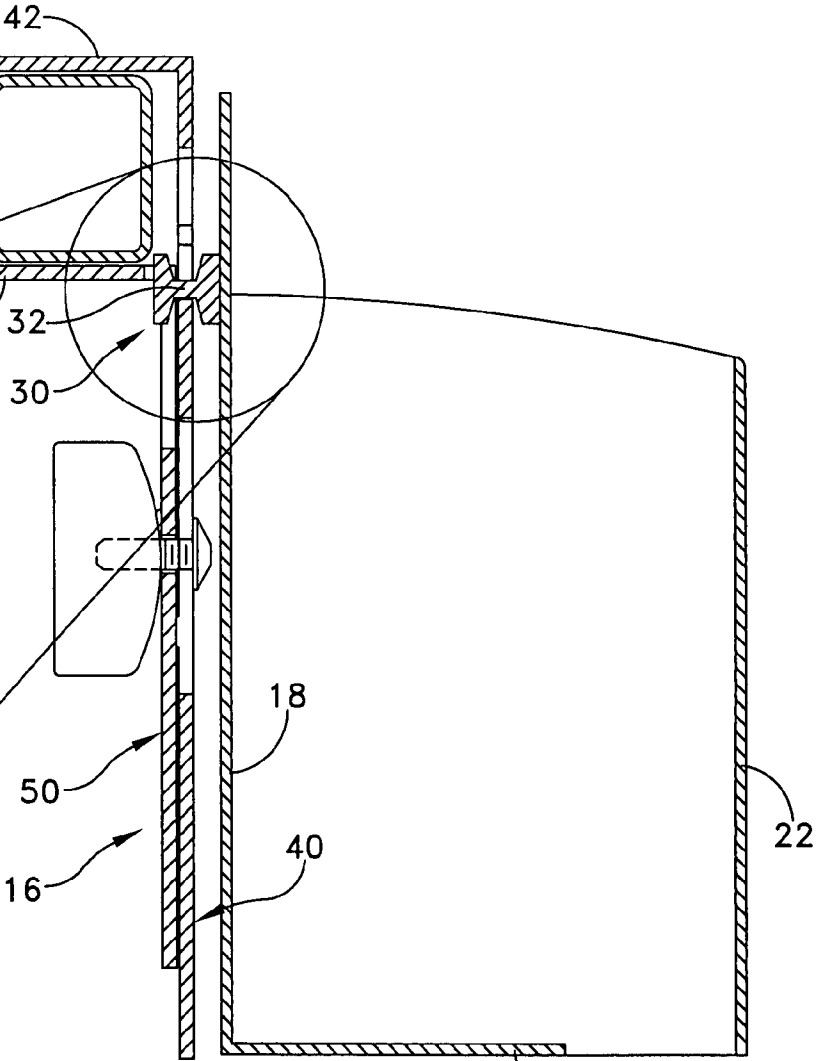
FIG. 13 is a cross-sectional view of the holder and mounting bracket in its engaged position.
Figure 14:
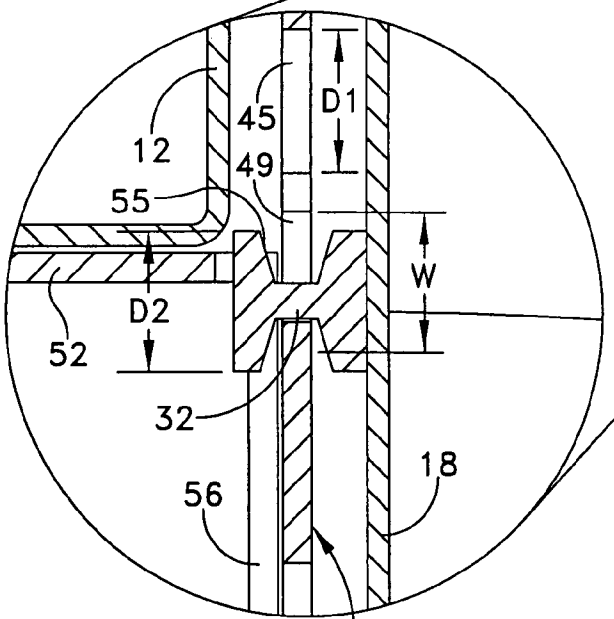
FIG. 14 is a fragmentary enlarged view of the area where the headed stud engages with the mounting bracket.

Reference is now also made to FIGS. 12-14 for illustrating the alignment between the multi-walled structure of the holder and the mounting bracket. In FIG. 12 the holder is illustrated with the headed stud in line with the round hole 45 of the bracket. Arrow 51 indicates the direction or movement of the holder toward the mounting bracket. The headed stud 30 has, at its head, a diameter of D2 and a restricted neck 32. The hole 45 has a diameter D1 that is greater than the diameter D2. In this way the headed stud 30 can pass into and through the round hole 45 so that the holder can engage with the mounting bracket. Thereafter, such as in the position illustrated in FIGS. 13 and 14, the headed stud 32, after engagement through the hole 45, moves downwardly so that the neck 32 of the headed stud 30 engages within the arcuate slot 49. The width W of the slot 49 is less than the diameter D2 of the head of the stud 32 so that the stud 32 is retained within the arcuate slot 49. Although it is retained within the slot, it is readily free to transition in the slot as the diameter at the neck 32 is substantially smaller than the width of the slot, as can be readily seen in the cross-sectional view of FIG. 14.

This stud and slot arrangement enables one to easily attach the holder to the mounting bracket. Likewise, one can lift the holder from the slot so as to realign the stud with the round hole 45 and then easily remove the holder from the mounting bracket. The headed stud is easily moved between the round hole and the arcuate slot through the connecting gap 53. This gap dimension G is greater than the diameter at the neck 32 so that the headed stud can move between the round hole 45 and the arcuate slot 49. Moreover, as seen in, for example, FIG. 12 the wall that transitions between the head and neck 32 is preferably tapered. This tends to reduce friction as the head is moved through the opening or passage 48 between engagement and disengagement positions. See also FIG. 14 and the tapered wall 55 that permits minimal contact between the head and slot/hole configuration.

This support between the holder and bracket is advantageous in that it enables one to quickly and easily engage the holder with the bracket, and also permits ready disengagement therebetween, all while providing a secure interlocking that prevents the holder from inadvertently disengaging from the supporting bracket. The headed member in combination with the slot configuration enables this ready engagement and disengagement. More particularly, the hole 45 enables ready engagement with the headed stud 30 while the engagement between the headed stud (particularly the neck 32) and the arcuate slot 49 enables both pivoting and interlocking to prevent the holder from separating from the bracket. A simple lifting of the holder so that the head then aligns with the hole 45 enables ready removal of the holder from the bracket.

Figure 15:
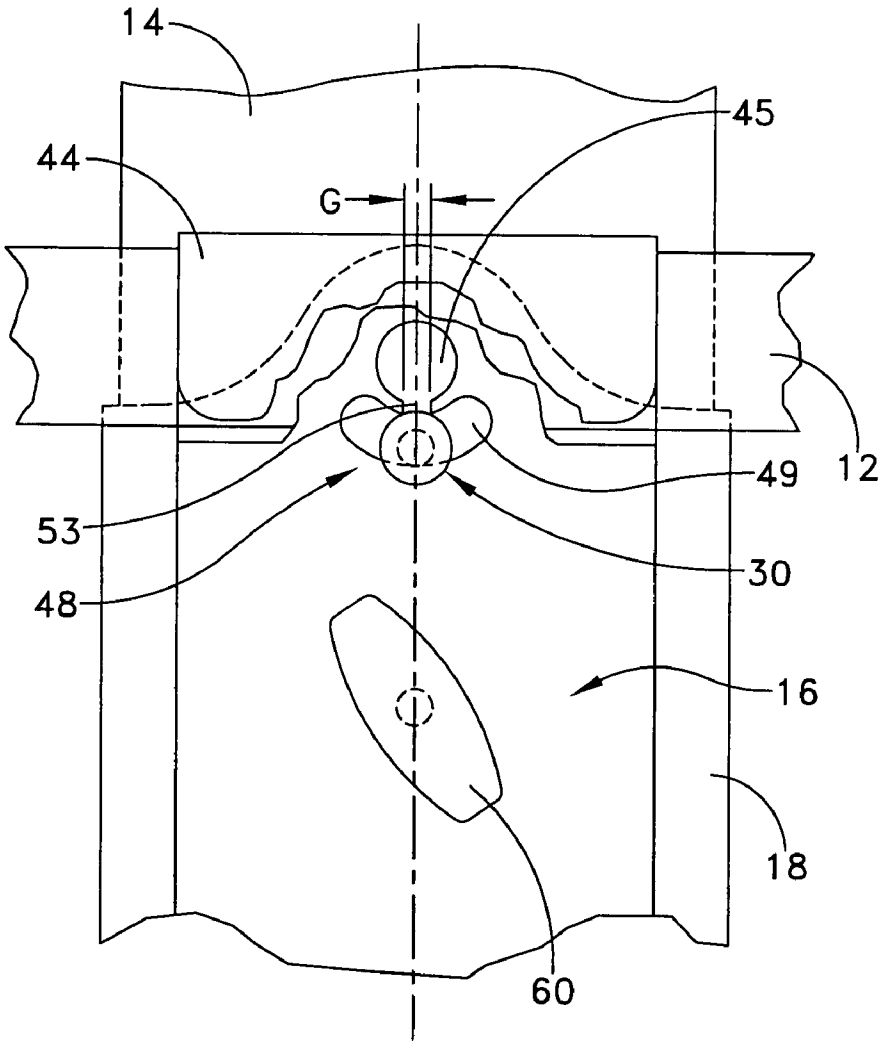
FIG. 15 is a partially cut away rear view of the mounting bracket and holder.
Figure 16:
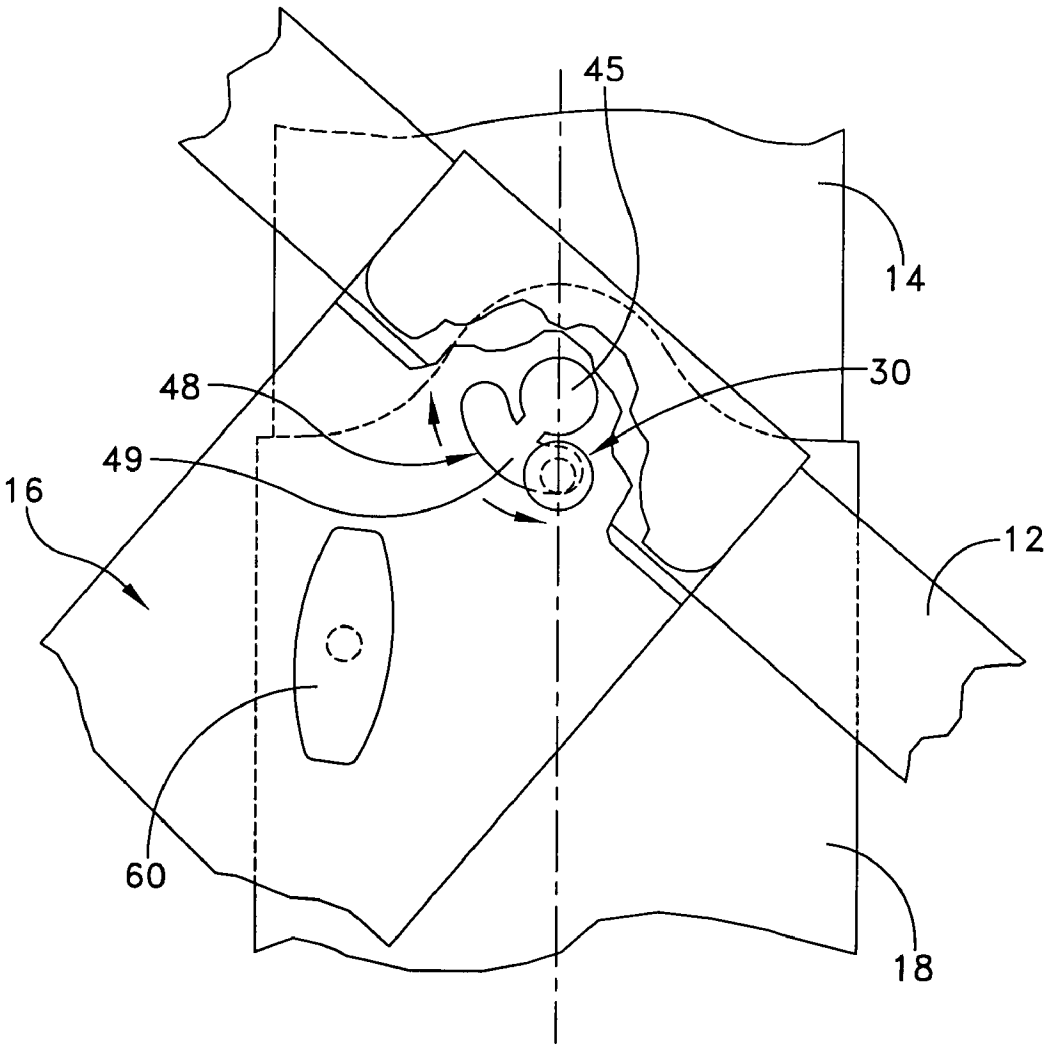
FIG. 16 is a view similar to that of FIG. 15 but illustrating the position of the holder when the bedrail is tilted.

Reference is now made to FIGS. 15 and 16 for an illustration of another important aspect of the present invention relating to the ease with which the holder stays in an upright position even when the bed is raised or lowered. FIG. 15 illustrates the mounting bracket on the bedrail 12 with the rail in a substantially horizontal position. In that position the headed stud 30 is essentially at the middle of the arcuate slot 49, as illustrated. FIG. 16 illustrates the bedrail 12 having now been tilted. Because the mounting bracket 16 is secured to the bedrail, that likewise will tilt with the tilting of the rail 12. However, when this occurs, the headed stud 30 simply, under gravity, transitions along the arcuate slot 49, such as to the position illustrated in FIG. 16. If the rail is tilted in the opposite direction or if the holder is mounted on the opposite side of the bed, then the headed stud transitions to the opposite end of the arcuate slot, all the while keeping the holder upright.

Figure 17:
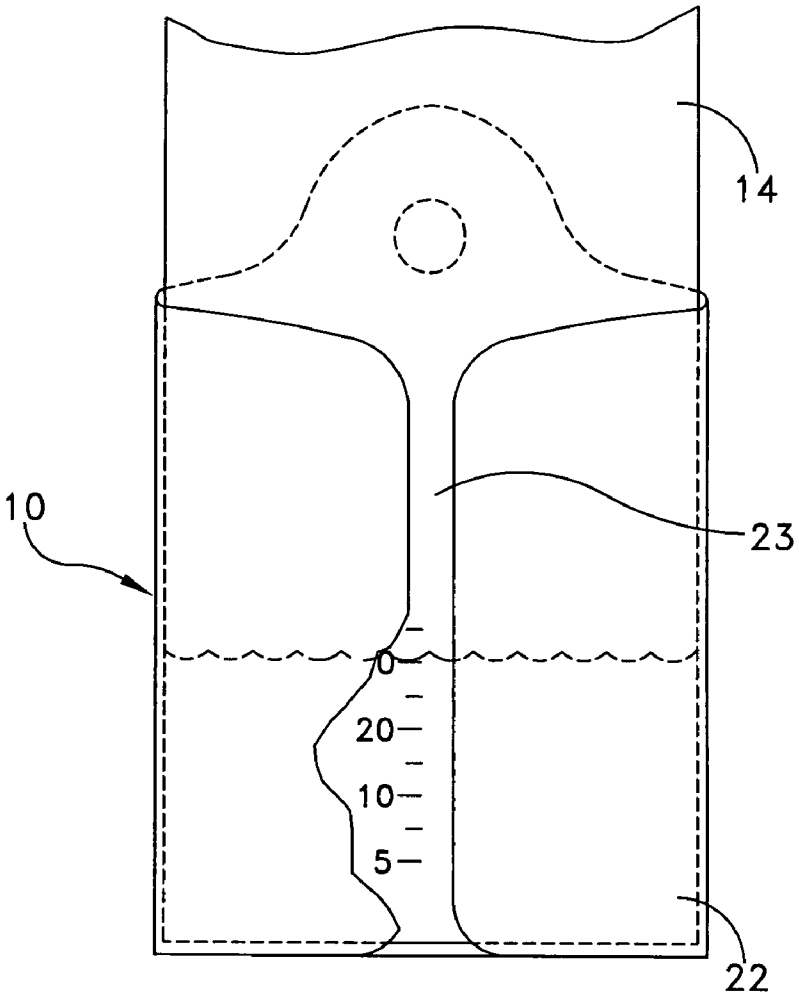
FIG. 17 is a partially cut away front view of the holder with the urinal disposed therein.

A further aspect of the present invention is illustrated in FIG. 17 wherein the front wall 22 of the multi-wall structure that contains the urinal, is provided with an elongated gap 23 through which the plastic urinal bottle can be observed. In this way one can see the level of the liquid that is within the hand-held urinal without having to withdraw the urinal from the holder.

While this disclosure has been particularly shown and described with references to preferred embodiments thereof, it will be understood by those skilled in the art that various changes in form and details may be made therein without departing from the spirit and scope of the disclosure as defined by the appended claims. For example, in the disclosed embodiment the male member (30) is carried by the holder while the female member (40) is carried by the mounting bracket. In an alternate embodiment of the invention the male member may be on the bracket while the female member (slot) is in the holder. Also, in one embodiment the components can be made of metal while in another embodiment they can be made of a plastic material, or combinations of metal and plastic.

What is claimed is:

1. A holder for a hand-held urinal that is for releasable mounting from a bed rail, comprising:

a mounting bracket including a pair of plate members that are supportable from the bed rail and that further include a lip means that restricts the adjustment between the plate members to a direction of a longitudinal axis of the plate members;

a knob and mating bolt for holding the plate members together and enabling adjustment therebetween so as to fit and be secured to the bed rail;

said knob having loose and tight positions, in the loose position being adjustable to enable the plate members to move relative to each other in the direction of the longitudinal axis, and in the tight position securing the plate members in a fixed orientation;

said pair of plate members including one and another plate members;

said one plate member having a top flange, a down-turned edge disposed orthogonal to said top flange and a main plate section orthogonal to said top flange;

said another plate member having a top flange and a main plate section orthogonal to said top flange;

said one plate member having a longitudinal slot and said another plate member having a through hole;

said knob and bolt positioned with the bolt extending through the longitudinal slot and through hole;

a multi-walled holder for receiving the hand-held urinal and including a bottom wall upon which the urinal rests;

said one plate member further having means defining a circular hole of predetermined diameter and an arcuate slot, said circular hole being disposed contiguous with and disposed over the predetermined width arcuate slot;

said one plate member further having a connecting gap that extends contiguously between said circular hole and arcuate slot, said connecting gap for interconnecting the hole with the arcuate slot;

said holder being removably supportable from said one plate member;

a headed stud on said holder and constructed and arranged facing said one plate member;

said headed stud defined by a head and a neck and being disposed extending from a rear wall of the holder adjacent a top end thereof;

said neck having a circular shape so that the holder can swing under gravity to stay substantially vertical even as the mounting bracket tilts;

said connecting gap extending vertically so as to allow the headed stud neck to fall, with gravity, from the hole, through the connecting gap to the arcuate slot;

said neck having a smaller diameter than the diameter of the head;

said arcuate slot having a predetermined radius with a midpoint at a vertical centerline of the one plate member, said midpoint of said arcuate slot being disposed further from the mounting bracket top flange than opposed ends of said arcuate slot;

said circular hole disposed with its center spaced above the midpoint of the arcuate slot;

the diameter of the head of the headed stud being less than the diameter of the circular hole on the plate member so that the head of the headed stud can pass through the circular hole for initial positioning of the holder, and being greater than the width of both the arcuate slot and gap so that the head of the headed stud is retained within the arcuate slot but is free to slide therealong;

said headed stud initially received in said hole and subsequently positioned via the connecting gap with the neck engaged in the arcuate slot so as to permit pivotal support of said holder from said mounting bracket while providing limited sliding motion between said headed stud and slot so as to enable the holder, under gravity, to stay substantially vertical even as the mounting bracket tilts.

2. The holder of claim 1 wherein the multi-walled holder includes a front wall with an elongated vertical gap through which the content of the urinal can be observed.

3. The holder of claim 1 wherein the headed stud also includes a base with the base of a larger diameter than that of the neck portion so that the neck portion forms a groove that keeps the headed stud in the arcuate slot.

4. The holder of claim 3 wherein another plate member has a hole larger than the through hole therein, said larger hole providing access for the headed stud.

* * * * *